US009592615B1

(12) United States Patent
Broeske

(10) Patent No.: US 9,592,615 B1
(45) Date of Patent: Mar. 14, 2017

(54) LIGHTED RAZOR SYSTEMS

(71) Applicant: Karen Broeske, Wonder Lake, IL (US)

(72) Inventor: Karen Broeske, Wonder Lake, IL (US)

( * ) Notice: Subject to any disclaimer, the term of this patent is extended or adjusted under 35 U.S.C. 154(b) by 0 days.

(21) Appl. No.: 14/599,680

(22) Filed: Jan. 19, 2015

Related U.S. Application Data

(60) Provisional application No. 61/934,650, filed on Jan. 31, 2014.

(51) Int. Cl.

| | |
|---|---|
| ***B26B 19/46*** | (2006.01) |
| ***B26B 21/46*** | (2006.01) |
| ***B26B 21/14*** | (2006.01) |
| ***B26B 21/40*** | (2006.01) |
| ***F21V 23/04*** | (2006.01) |
| ***F21V 23/02*** | (2006.01) |
| ***F21V 31/00*** | (2006.01) |
| *F21Y 101/02* | (2006.01) |

(52) U.S. Cl.
CPC ..... *B26B 21/46* (2013.01); *B26B 21/14* (2013.01); *B26B 21/4081* (2013.01); *F21V 23/023* (2013.01); *F21V 23/04* (2013.01); *F21V 31/005* (2013.01); *F21Y 2101/02* (2013.01)

(58) Field of Classification Search
CPC ..... B26B 21/46; B26B 21/14; B26B 21/4081; F21V 23/023; F21V 23/04; F21V 31/005; F21Y 2101/02
USPC ..... 362/115; 30/34.05
See application file for complete search history.

(56) References Cited

U.S. PATENT DOCUMENTS

| | | | | |
|---|---|---|---|---|
| 4,094,062 | A | 6/1978 | Papanikolaou | |
| 5,582,476 | A | 12/1996 | Hansen | |
| 6,481,104 | B1 * | 11/2002 | Parker | B26B 21/38 30/45 |
| 6,915,576 | B2 | 7/2005 | Brzezinski | |
| 2006/0260142 | A1 * | 11/2006 | Dombrowski | B26B 21/38 30/526 |
| 2009/0071008 | A1 * | 3/2009 | Hart | B26B 21/222 30/34.05 |
| 2013/0312264 | A1 * | 11/2013 | Cohen | B26B 21/526 30/34.05 |

* cited by examiner

*Primary Examiner* — Evan Dzierzynski
(74) *Attorney, Agent, or Firm* — Scherrer Patent & Trademark Law, P.C.; Stephen T. Scherrer; Monique A. Morneault

(57) ABSTRACT

A lighted razor system with a lighted razor assembly having a handle having a proximate end, a distal end, a transparent shaft, and an inner volume; a head; at least one blade; an illuminator; an on/off switch; and a powerer. The lighted razor assembly has in functional combination the handle, the head, the at least one blade, the illuminator, and the powerer. The lighted razor system is useful to permit the lighted shaving means with illumination present such that accuracy in cutting and movement of the lighted razor assembly is improved in relation to a body surface of a user.

17 Claims, 6 Drawing Sheets

LIGHTED RAZOR SYSTEMS

CROSS-REFERENCE TO RELATED APPLICATION

The present application is related to and claims priority from prior provisional application Ser. No. 61/934,650, filed Jan. 31, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of shaving devices and more specifically relates to a lighted razor system.

2. Description of the Related Art

For most individuals, maintaining proper personal hygiene is essential to their well-being. Effective defense in the battles against germs and bacteria, hygiene rituals are important for making a person feel clean and fresh on a daily basis. Whether brushing the teeth after every meal, washing the hands after daily activities, or basking in a soothing tub of bath water after work, people practice a plethora of hygienic exercises that not only cleanse the body but also refresh the spirit. One hygiene ritual practiced by both men and women is shaving. The process of removing unwanted hair, shaving, is a custom that has been practiced throughout history. In fact, as early as the Bronze Age, men used primitive razors made of iron, bronze, and gold to shear away facial hair. In ancient Egypt, children as well as adults shaved their bodies from head to toe, as this entirely smooth appearance allowed them to remain cool in the sweltering climate while also halting the spread of disease. Shaving today is more of a cosmetic ritual, as the removal of excess body hair presents a well groomed appearance that is attractive and professional.

The standard tool used for removing unwanted hair is the razor. While offered in a vast array of varieties, from the simple straightedge to the advanced electric versions, the majority of adult consumers prefer to utilize a simple, handheld safety razor for their shaving needs. Featuring a disposable blade cartridge that easily snaps onto a metal or plastic handle, safety razors provide a close shave in an easy and expedient fashion. However, as convenient as these razors are for personal grooming, shaving with them can sometimes prove challenging, especially for those who shave while showering in order to save time. Enclosed within a curtain or door, the shower area is often dimly lit; even with a handy bath mirror at the ready, it can be difficult for users to clearly see where their razor is traveling. Thus, when shearing a large area of body hair in places that require it, such as the cheeks or the legs, it is not uncommon for shavers to experience a less-than-close cut, leaving behind stubble that must be run over again with the razor in order to achieve the desired smoothness.

Additionally, when men are attempting to sculpt a perfectly formed goatee or Van Dyke or women are endeavoring to shave the bikini area, precision can be difficult to attain in such a darkened environment. Not only can these shaving attempts result in 'crooked' hairlines and the accidental removal of hair the user wishes to keep, but they can also leave behind a painful and unattractive collection of cuts and nicks. This is not desirable.

Various attempts have been made to solve problems found in shaving device art. Among these are found in: U.S. Pat. No. 5,582,476 to James W. Hansen; U.S. Pat. No. 4,094,062 to Sotirios Papanikolaou; and U.S. Pat. No. 6,915,576 to Lisa M. Brzezinski. This prior art is representative of shaving means. None of the above inventions and patents, taken either singly or in combination, is seen to describe the invention as claimed.

Ideally, a lighted razor system would be user-friendly and safe in-use and, yet may operate reliably and be manufactured at a modest expense. Thus, a need exists for a lighted razor system to permit lighted shaving means with illumination present such that accuracy in cutting and movement of a lighted razor assembly is improved in relation to a body surface of a user and to avoid the above-mentioned problems.

BRIEF SUMMARY OF THE INVENTION

In view of the foregoing disadvantages inherent in the known shaving device art, the present invention provides a novel lighted razor system. The general purpose of the present invention, which will be described subsequently in greater detail is to provide lighted razor system to permit lighted shaving means with illumination present such that accuracy in cutting and movement of a lighted razor assembly is improved in relation to a body surface of a user.

A lighted razor system is disclosed herein, in a preferred embodiment, comprising: a lighted razor assembly having a handle having a proximate end, a distal end, a transparent shaft, and an inner volume; a head; at least one blade; an illuminator; an on/off switch; and a powerer. The lighted razor system comprises the lighted razor assembly. The lighted razor assembly comprises in functional combination the handle, the head, the at least one blade, the illuminator, and the powerer. The lighted razor system is useful to permit the lighted shaving means with illumination present such that accuracy in cutting and movement of the lighted razor assembly is improved in relation to a body surface of a user.

The lighted razor assembly is preferably watertight via seals located in the handle. The handle is defined by the proximate end and the distal end; the distal end adjacent the head; the inner volume able to contain the powerer therein with wiring to connect the illuminator to the powerer for use. The illuminator comprises at least one LED or light source in preferred embodiments, given their cost-effective and efficient lighting means. The at least one blade is integral with the head; the at least one blade structured and arranged to cut hair. The head is removable from the handle via clips. The illuminator is able to be powered by the powerer to provide lighted shaving means. The on/off switch may comprise an end-button located adjacent the proximate end on the handle. The end-button is depressible such that the illuminator can be manipulated between an on-condition and an off-condition.

The proximate end preferably comprises a gripped-handle. The handle comprises a forward-facing-light-lens for directing the illumination emitting from the illuminator. The handle further comprises a downward-facing-light-lens for directing the illumination emitting from the illuminator. The transparent shaft is adjacent the distal end of the handle. The transparent shaft is able to emit the illumination propagated from the at least one LED or light source. The transparent shaft preferably comprises plastic such that the handle is durable, waterproof and flexible. The powerer comprises at least one DC battery.

A kit is also embodied herein for the lighted razor system comprising at least: a lighted razor assembly; a powerer; and a set of user instructions.

A method of using a lighted razor system comprising the steps of: holding a lighted razor assembly ready for a shaving episode; illuminating an illuminator via activating a single depression on an end-button; and shaving. The method further comprising the step of de-illuminating the illuminator via another depression on the end-button.

The present invention holds significant improvements and serves as a lighted razor system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, lighted razor systems constructed and operative according to the teachings of the present invention.

The various embodiments of the present invention will hereinafter be described in conjunction with the appended drawings, wherein like designations denote like elements.

DETAILED DESCRIPTION

Figure 1:
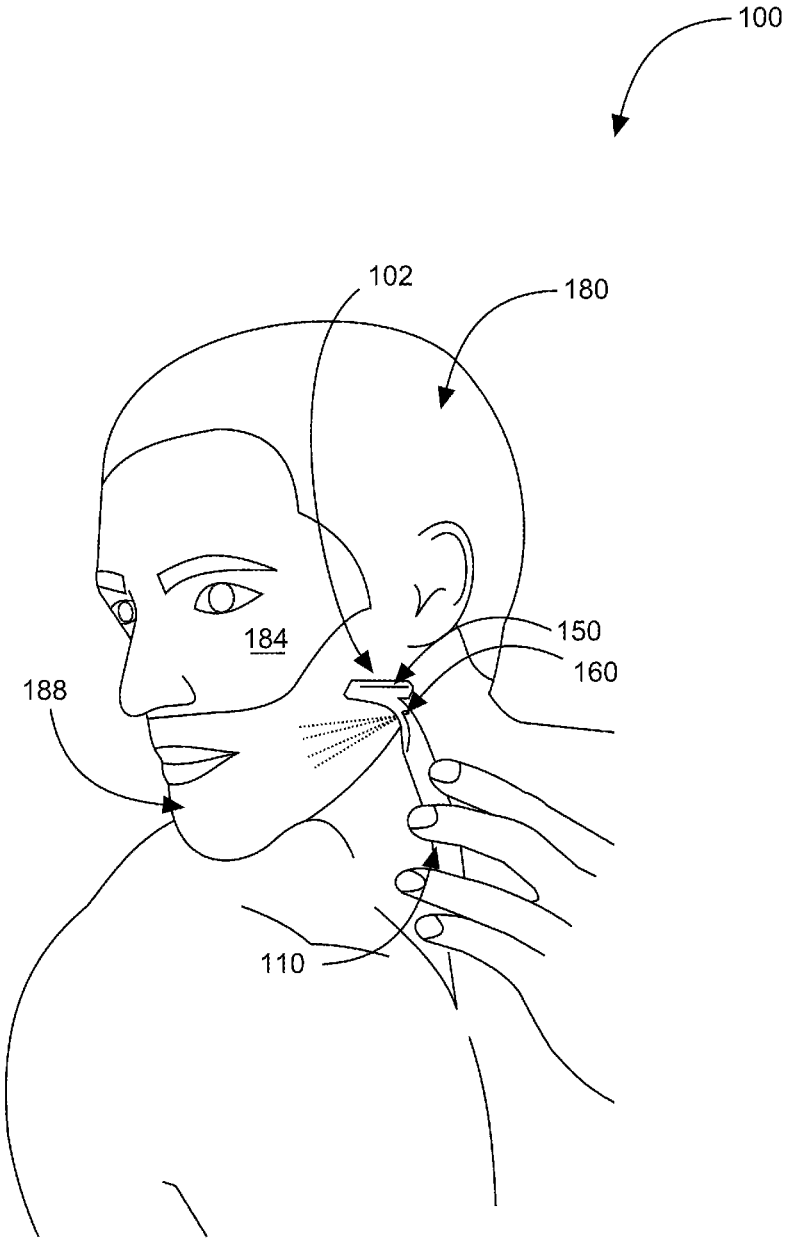
FIG. 1 shows a perspective view illustrating a lighted razor system in an in-use condition according to an embodiment of the present invention.

As discussed above, embodiments of the present invention relate to a shaving device and more particularly to a lighted razor system to permit lighted shaving means with illumination present such that accuracy in cutting and movement of a lighted razor assembly is improved in relation to a body surface of a user.

Generally speaking, the Lighted Razor Systems comprises a line of shaving tools that feature an incorporated light source. Initially offered as a standard disposable unit, the Lighted Razor System may be fabricated of a durable plastic material. Resembling the common safety razor, this product may be comprised of a vertical handle topped with an integrally attached blade cartridge; as such, the Lighted Razor Systems may offer dimensions of approximately four and one half inches (4½") in length and one half inch (½") in circumference for the handle, and a width of one and five eighths inches (1⅝") for the cartridge.

The present invention uniquely comprises a light source. This may be comprised of a light emitting diode (LED) or light source positioned at the distal end of the handle, projected through a dual lens system above and below this area. To facilitate an increased area of light, an angled, clear plastic additional shaft may be located in the area between the handle and cartridge. The LED or light source may be connected to a light gauge wire or metal ribbon located inside the handle, which may extend to the proximal end of the handle to join with a handy push-button mechanism that triggers the light source. Power to the Lighted Razor may be provided by a compact silver oxide cell battery or power source, similar to the type used for wristwatches.

While this line may be produced in convenient disposable varieties, the Lighted Razor Systems concept may be easily incorporated into reusable cartridge units as well as high-end stainless steel razors. In addition, the Lighted Razor Systems and any additional components may be made available in a variety of colors to appeal to individual tastes.

Use of the Lighted Razor Systems may comprise: first, the user may lather the area of the body to be shaved with the preferred brand of shaving cream or gel. Next, the proximal button may be pressed, and the distal end of the razor is able to emit a wide swath of illumination. The user may begin shaving in the usual manner. Guiding the instrument and its spotlight over the body, the user is able to comfortably and confidently groom all areas, as the light facilitates the efficient cutting away of the angles, curves, and curls of unwanted body and facial hair, without worry that the blade will slice away a portion of a beard or cut into the skin. After use, the blade cartridge can remain on the handle for another use or be simply discarded in the nearest trash receptacle.

There are several significant benefits and advantages associated with the Lighted Razor Systems. Foremost, this present invention may provide consumers with a personal grooming tool that can be more easily controlled while in use, specifically in darkened environments such as a shower area. Offering a vast area of illumination to accommodate detailed, exact, and expedient grooming, the creative Lighted Razor Systems may allow users to maintain certain facial hair styles and a clean, close, attractive appearance in other areas in a hassle-free manner. As a result, consumers can confidently attend to their shaving rituals without fear of painful cuts and scrapes.

Extremely easy to use and comfortable to hold, this handy product may be perfect for use when shaving is required on a daily basis. Ideal for both men and women, the Lighted Razor System may be especially appreciated by business professionals, whose vocations require that they constantly maintain a well-groomed appearance. Perfect for home use, this product may be particularly ideal while camping, when early morning light may not be sufficient to see well enough to achieve a perfect shave.

Attractive as well as practical, the Lighted Razor Systems may offer a much needed alternative to standard safety razors. Whether standing over the bathroom sink to groom the face and neck or lying in a bathtub to shave the legs, users will certainly appreciate the security and comfort afforded by this novel product.

Figure 2:
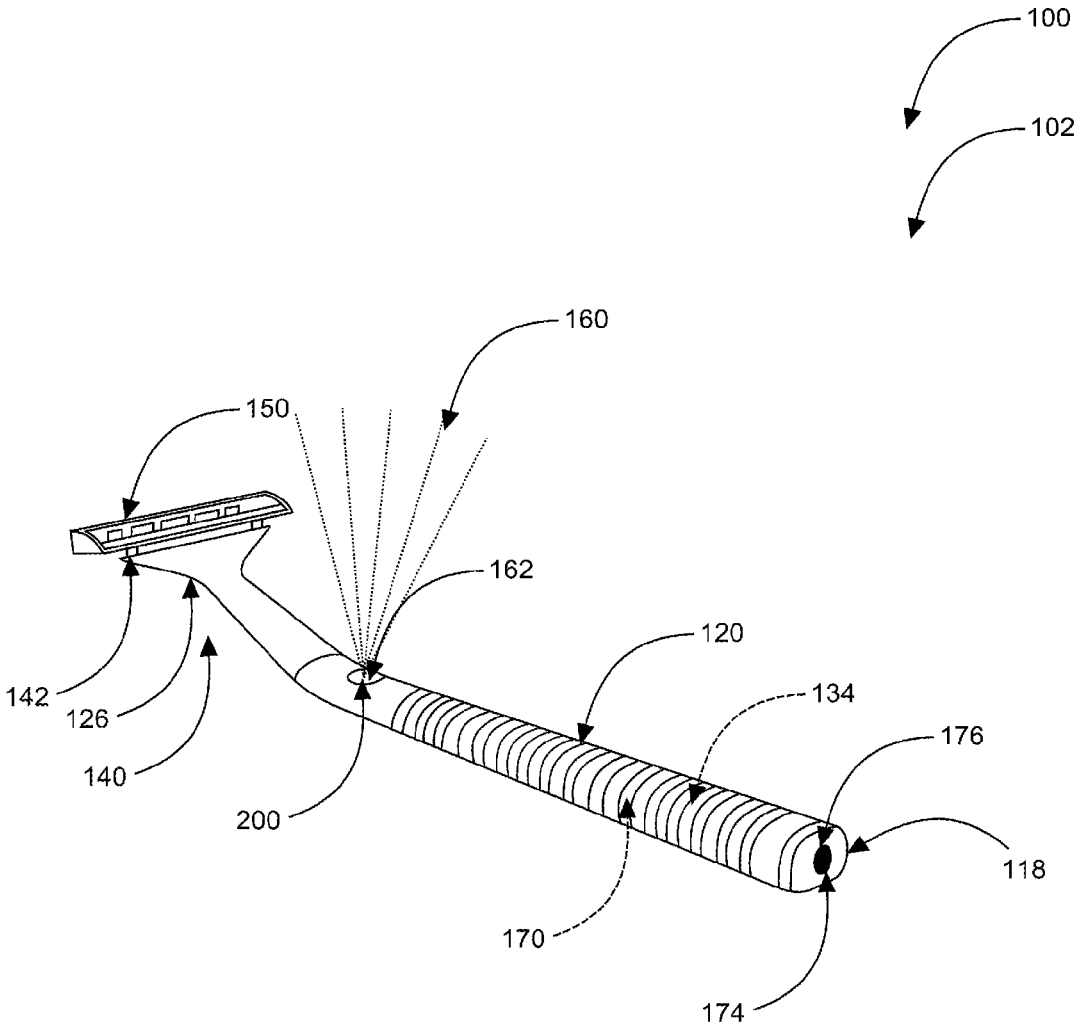
FIG. 2 is a bottom perspective view illustrating a lighted razor assembly of the lighted razor system according to an embodiment of the present invention of FIG. 1.
Figure 3:
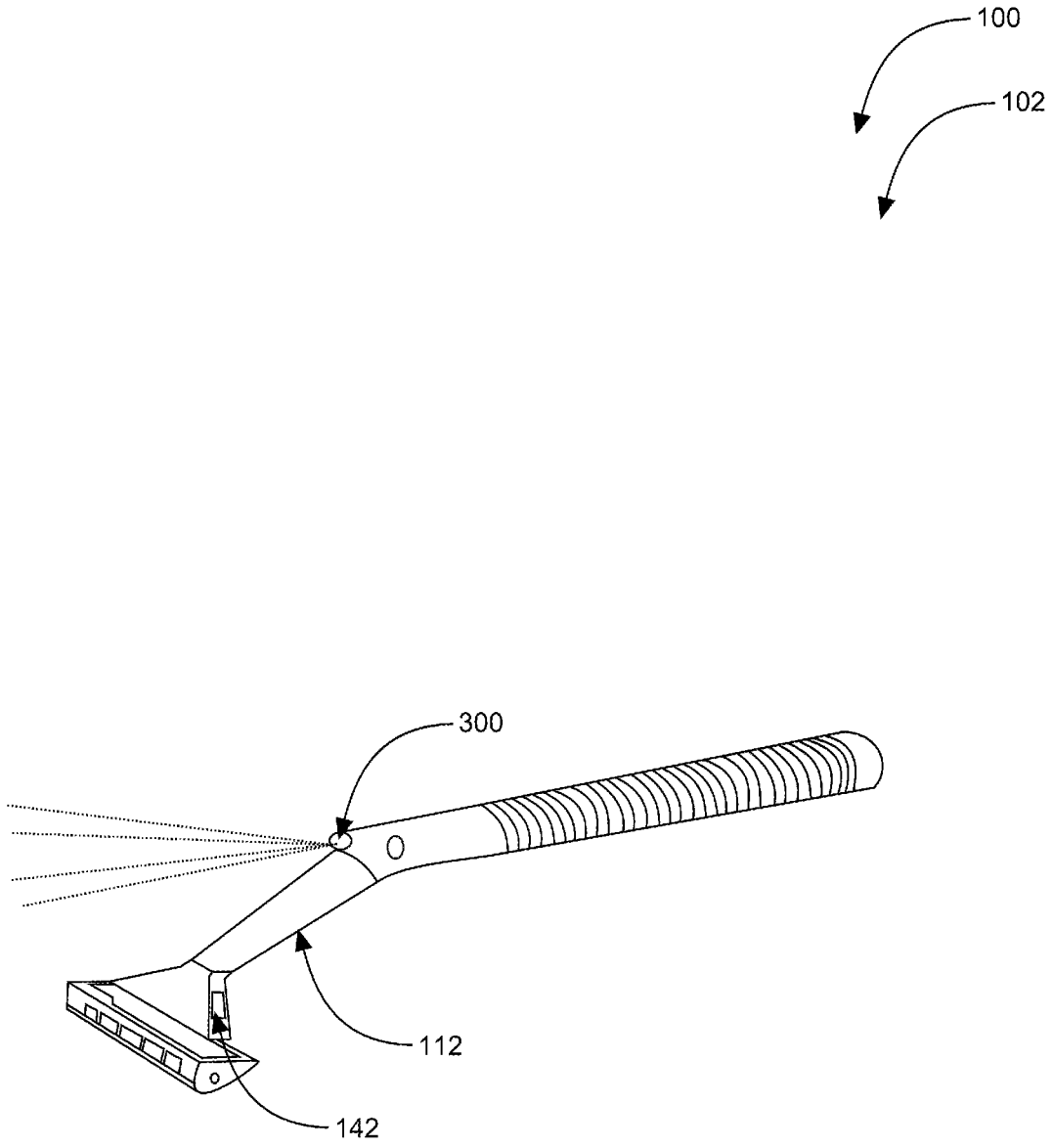
FIG. 3 is a top perspective view illustrating the lighted razor assembly of the lighted razor system according to an embodiment of the present invention of FIG. 1.

Referring now to the drawings by numerals of reference there is shown in FIGS. 1-3 perspective views illustrating lighted razor assembly 102 of lighted razor system 100 according to an embodiment of the present invention.

Lighted razor system 100 comprises: lighted razor assembly 102 including handle 110 having proximate end 118, distal end 126, and inner volume 134; head 140; at least one blade 150; illuminator 160; and power source 170. Lighted razor system 100 comprises lighted razor assembly 102. Lighted razor assembly 102 comprises in functional combination handle 110, head 140, at least one blade 150, illuminator 160, and power source 170. Lighted razor assembly 102 is watertight via seals 104*a*, 104*b* located in handle 110. Handle 110 is defined by proximate end 118 and distal end 126; distal end 126 adjacent head 140, inner volume 134 able to contain power source 170 therein with wiring 106 to connect illuminator 160 to power source 170 for use. Head 140 may be removable from handle 110 via clips 142.

At least one blade 150 is preferably integral with head 140; at least one blade 150 structured and arranged to cut hair 188. At least one blade 150 is held in a cartridge (not shown).

Illuminator 160 is able to be powered by power source 170 to provide lighted shaving means. Power source 170 comprises at least one DC battery. Handle 110 further comprises downward-facing-light-lens 200 for directing illumination emitting from illuminator 160 as shown in FIG. 2. Handle 110 comprises forward-facing-light-lens 300 for directing illumination emitting from illuminator 160 as shown in FIG. 3. Lighted razor system 100 is useful to permit lighted shaving means with illumination present such that accuracy in cutting and movement of lighted razor assembly 102 is improved in relation to body surface 184 of user 180. Illuminator 160 preferably comprises at least one LED 162. It should be noted that other light sources may be suitably used.

Figure 4:
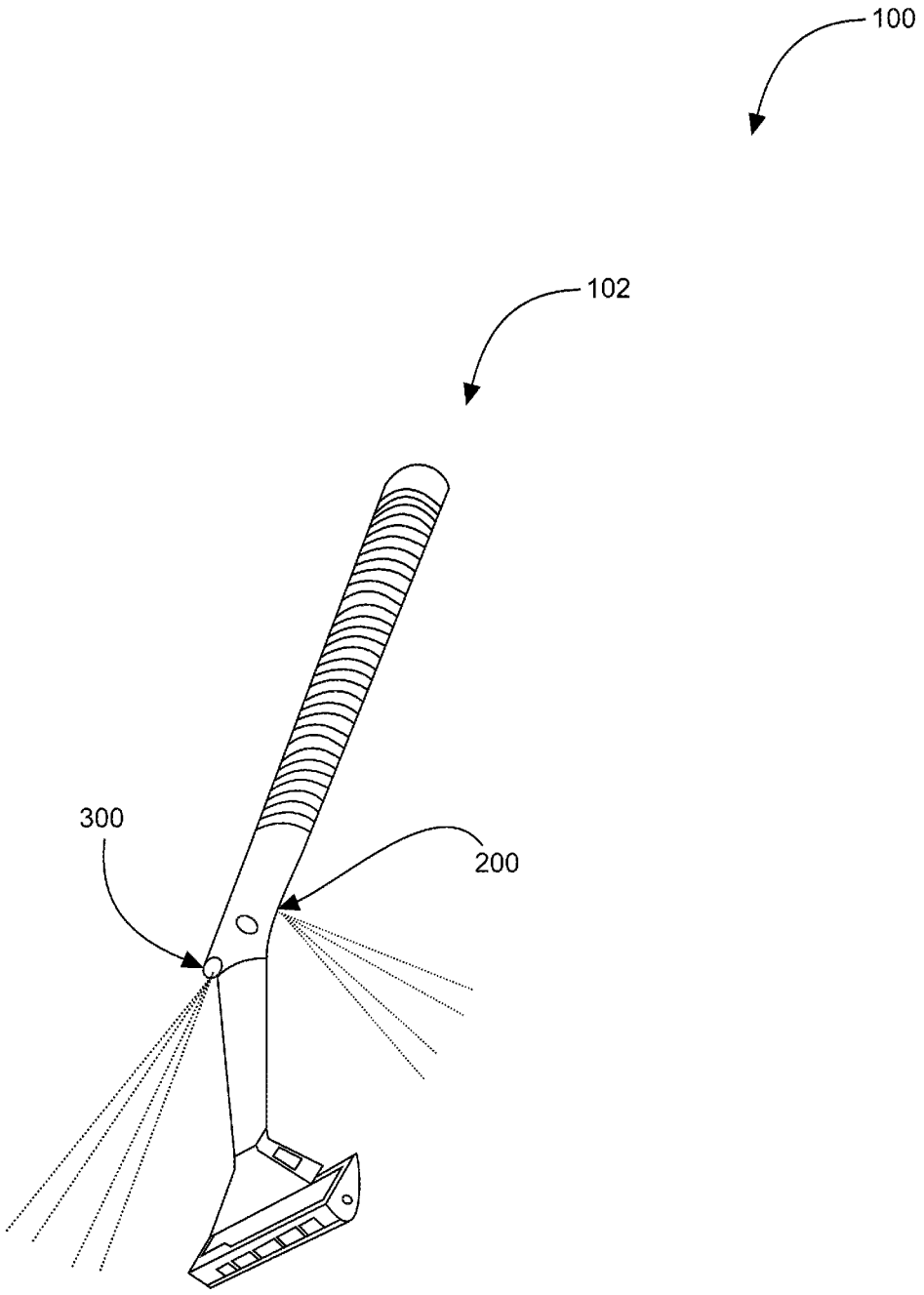
FIG. 4 is a side perspective view illustrating another view of the lighted razor assembly of the lighted razor system according to an embodiment of the present invention of FIG. 1.

Lighted razor assembly 102 further comprises on/off switch 174. On/off switch 174 comprises end-button 176 located adjacent proximate end 118 on handle 110. End-button 176 is depressible such that illuminator 160 can be manipulated between an on-condition and an off-condition. Proximate end 118 comprises gripped-handle 120. Handle 110 comprises transparent shaft adjacent 112 located at distal end 126 of handle 110. Transparent shaft 112 comprises plastic such that handle 110 is durable, waterproof and flexible. Transparent shaft 112 is able to emit illumination propagated from at least one LED 162. At least one LED 162 illuminates white. FIG. 4 is a side perspective view illustrating another view of the lighted razor assembly of the lighted razor system according to an embodiment of the present invention of FIG. 1.

Lighted razor system 100 may be sold as a kit (not shown) comprising the following parts: at least one lighted razor assembly 102; power source 170; and at least one set of user instructions. The kit has instructions such that functional relationships are detailed in relation to the structure of the invention (such that the invention can be used, maintained, or the like in a preferred manner). Lighted razor system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different blade combinations, parts may be sold separately, etc., may be sufficient.

Figure 5:
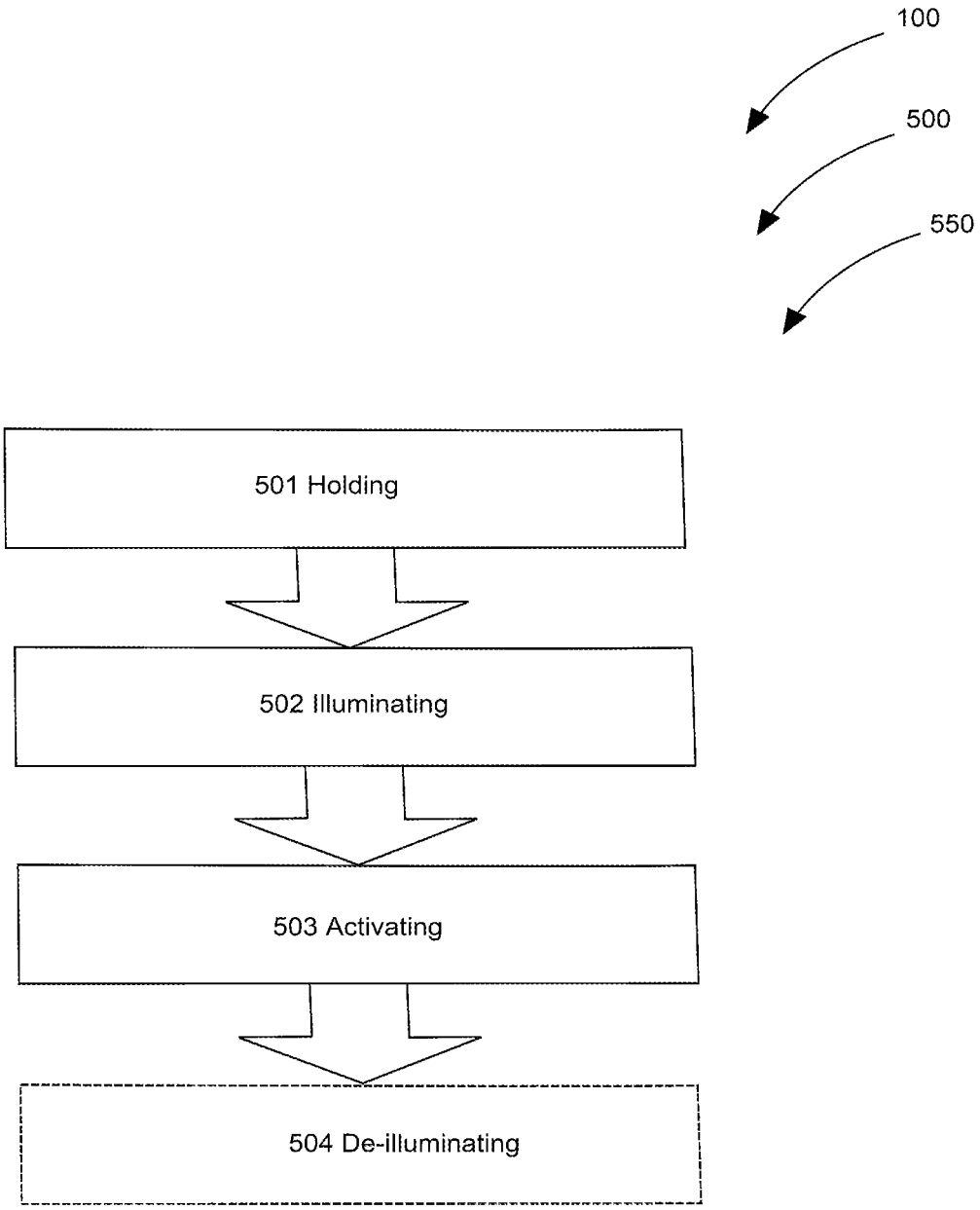
FIG. 5 is a flowchart illustrating a method of use for the lighted razor system according to an embodiment of the present invention of FIGS. 1-4.
Figure 6:
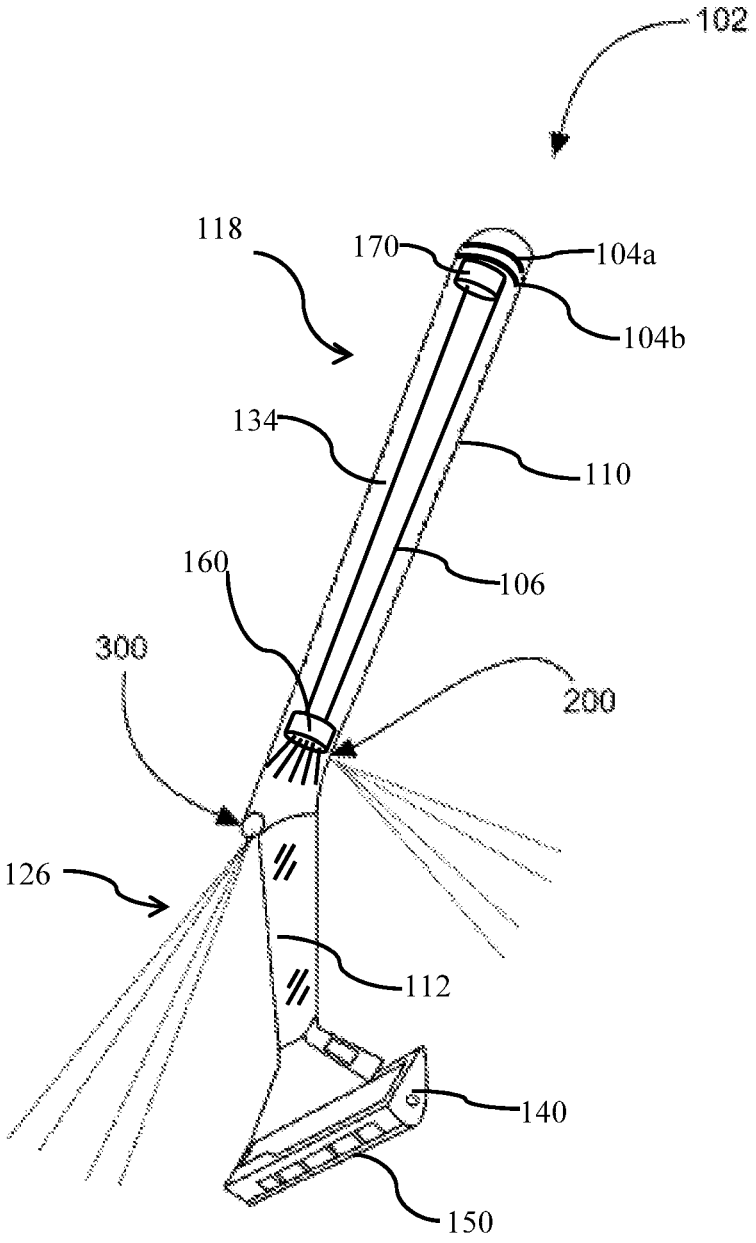
FIG. 6 shows a cut-away perspective view illustrating a lighted razor system according to an embodiment of the present invention.

Referring now to FIG. 5, showing flowchart 550 illustrating method of use 500 for lighted razor system 100 according to an embodiment of the present invention of FIGS. 1-4.

Method of using (method of use 500) lighted razor system 100 comprises the steps of: step one 501 holding lighted razor assembly 102 ready for a shaving episode; step two 502 illuminating illuminator 160 via activating a single depression on end-button 176; and step three 503 shaving. The method further comprising the step of step four 504 de-illuminating illuminator 160 via another depression on end-button 176. It should be noted that other activation means may be suitably used such as an activation switch.

It should be noted that step 504 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A lighted razor system comprising:

a lighted razor assembly having;

a handle having;

a proximate end;

a distal end;

an inner volume;
a neck;
a head;
at least one blade;
an illuminator;
a downward-facing light lens;
a forward-facing light lens; and
a power source;

wherein said handle is defined by said proximate end and said distal end, said distal end adjacent the neck, the neck extending downwardly at an angle from the distal end of the handle and adjacent said head, said inner volume able to contain said power source therein with wiring to connect said illuminator to said power source for use;

wherein said at least one blade is integral with said head;

wherein said downward-facing light lens is disposed at a location under the handle near the distal end of the handle;

wherein said forward-facing light lens is disposed on the distal end of the handle at a location where the neck joins the handle;

wherein said illuminator is disposed within the handle and powered by said power source to provide lighted shaving means; and wherein said illuminator directs illumination through the downward-facing light lens and the forward-facing light lens.

2. The lighted razor system of claim 1 wherein said head is removable from said handle.

3. The lighted razor system of claim 1 wherein said power source comprises at least one DC battery.

4. The lighted razor system of claim 1 wherein said illuminator comprises at least one LED.

5. The lighted razor system of claim 4 wherein said lighted razor assembly further comprises an on/off switch.

6. The lighted razor system of claim 5 wherein said on/off switch comprises an end button located adjacent said proximate end on said handle.

7. The lighted razor system of claim 6 wherein said proximate end comprises a gripped handle.

8. The lighted razor system of claim 6 wherein said end-button is depressible to turn the illuminator between an on-condition and an off-condition.

9. The lighted razor system of claim 1 wherein said neck comprises a transparent shaft.

10. The lighted razor system of claim 9 wherein said transparent shaft is able to emit said illumination propagated from said at least one LED.

11. The lighted razor system of claim 10 wherein said lighted razor assembly is watertight via seals located in said handle.

12. The lighted razor system of claim 9 wherein said transparent shaft comprises plastic such that said handle is waterproof and flexible.

13. The lighted razor system of claim 1 wherein said at least one LED illuminates white.

14. The lighted razor system of claim 1 wherein said at least one blade is held in a cartridge.

15. A lighted razor system comprising:

a lighted razor assembly having;

a handle having;

a proximate end;
a distal end; and
an inner volume;

a head;
a neck
at least one blade;
an illuminator;
a downward-facing light lens;
a forward-facing light lens;
an on/off switch; and
a power source;

wherein said handle is defined by said proximate end and said distal end, said distal end adjacent the neck, the neck extending downwardly at an angle from the distal end of the handle and adjacent said head, said inner volume able to contain said power source therein with wiring to connect said illuminator to said power source for use;

wherein said illuminator comprises at least one LED;

wherein said at least one blade is integral with said head;

wherein said head is removable from said handle via clips;

wherein said downward-facing light lens is disposed at a location under the handle near the distal end of the handle;

wherein said forward-facing light lens is disposed on the distal end of the handle at a location where the neck joins the handle;

wherein said illuminator is disposed within the handle and is powered by said power source to provide lighted shaving means;

wherein said illuminator directs illumination through the downward-facing light lens and the forward-facing light lens;

wherein said on/off switch comprises an end-button located adjacent said proximate end on said handle;

wherein said end-button is depressible to turn the illuminator between an on-condition and an off-condition;

wherein said proximate end comprises a gripped handle;

wherein said transparent shaft is adjacent said distal end of said handle;

wherein said neck comprises a transparent shaft that is emits said illumination propagated from said at least one LED;

wherein said transparent shaft comprises plastic such that said handle is waterproof and flexible;

wherein said power source comprises at least one DC battery;

wherein said lighted razor assembly is watertight via seals located in said handle.

16. A method of using a lighted razor system comprising the steps of:

holding a lighted razor assembly comprising a lighted razor assembly for shaving having an illuminator illuminated via activating an end button, the lighted razor assembly comprising a handle having a proximate end and a distal end, a neck disposed on the distal end of the handle and extending at an angle downwardly from the handle, a downward-facing light lens disposed at a location under the handle near the distal end of the handle; a forward-facing light lens disposed on the distal end of the handle at a location where the neck joins the handle; an illuminator disposed within the handle, wherein the illuminator directs illumination through the downward-facing light lens and the forward-facing light lens; and illuminating the illuminator via activating the single depression on the end-button.

17. The method of claim 16 further comprising the step of de-illuminating said illuminator via another depression on said end-button.

* * * * *